US008753087B2

(12) United States Patent
Shibukawa et al.

(10) Patent No.: US 8,753,087 B2
(45) Date of Patent: Jun. 17, 2014

(54) TURBINE ROTOR ASSEMBLY AND STEAM TURBINE

(75) Inventors: Naoki Shibukawa, Saitama (JP); Yoriharu Murata, Yokohama (JP); Akihiro Onoda, Yokohama (JP); Daisuke Nomura, Kawasaki (JP); Tomohiro Tejima, Yokohama (JP); Osamu Furuya, Kawasaki (JP); Kenichi Imai, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 490 days.

(21) Appl. No.: 12/979,004

(22) Filed: Dec. 27, 2010

(65) Prior Publication Data

US 2011/0158810 A1 Jun. 30, 2011

(30) Foreign Application Priority Data

Dec. 28, 2009 (JP) ..... 2009-298957

(51) Int. Cl.
*F01D 5/22* (2006.01)

(52) U.S. Cl.
USPC ..... 416/196 R

(58) Field of Classification Search
USPC ..... 416/196 R
See application file for complete search history.

(56) References Cited

U.S. PATENT DOCUMENTS

| | | | | |
|---|---|---|---|---|
| 2,772,854 | A * | 12/1956 | Anxionnaz | 416/190 |
| 3,719,432 | A * | 3/1973 | Musick | 416/196 R |
| 4,191,508 | A * | 3/1980 | Kuroda et al. | 416/196 R |
| 4,734,010 | A * | 3/1988 | Battig | 416/196 R |
| 6,341,941 | B1 | 1/2002 | Namura et al. | |
| 2004/0191068 | A1 | 9/2004 | Richter et al. | |
| 2009/0004011 | A1 | 1/2009 | Ootomo et al. | |

FOREIGN PATENT DOCUMENTS

| | | | |
|---|---|---|---|
| JP | 2002-295201 | A | 10/2002 |
| JP | 2003-269104 | A | 9/2003 |
| JP | 2004-340131 | A | 12/2004 |
| JP | 4058906 | B2 | 12/2007 |
| JP | 2009-007981 | A | 1/2009 |
| WO | WO 99/13200 | A1 | 3/1999 |

* cited by examiner

*Primary Examiner* — Nathaniel Wiehe
*Assistant Examiner* — Brian O Peters
(74) *Attorney, Agent, or Firm* — Foley & Lardner LLP

(57) ABSTRACT

A turbine rotor assembly 10 comprises a turbine rotor and a plurality of moving blades 20 implanted in a circumferential direction of the rotor. A flow passage is formed between each of the moving blades 20 and a circumferentially adjacent moving blade 20. Each of the moving blades 20 comprises a suction side connecting member 22 protruded on a blade suction surface 21 and a pressure side connecting member 24 protruded on a blade pressure surface 23, wherein the suction side connecting member 22 of each of the moving blades 20 is configured to be connected with the pressure side connecting member 24 of the circumferentially adjacent moving blade 20 to form an intermediate connecting member 30 between the moving blade 20 and the circumferentially adjacent moving blade 20 during a rotation of the turbine rotor. A downstream side end edge 32 of the intermediate connecting member 30 is positioned at an upstream side of a throat S of the flow passage.

13 Claims, 20 Drawing Sheets

TURBINE ROTOR ASSEMBLY AND STEAM TURBINE

CROSS-REFERENCE TO RELATED APPLICATION

This application is based upon and claims the benefit of priority from Japanese Patent Application No. 2009-298957, filed on Dec. 28, 2009; the entire contents of which are incorporated herein by reference.

FIELD

Embodiments described herein relate generally to a turbine rotor assembly and a steam turbine provided with the turbine rotor assembly.

BACKGROUND

In recent years, the flow rate of steam passing through the final stage of a steam turbine tends to increase as the provision of high output and high efficiency to the steam turbine progresses. To effectively expand steam as a working fluid, it is necessary that moving blades in a low pressure portion of the steam turbine are formed of long blades and an annular area is increased. But, when the moving blades are made long, a centrifugal stress increases and a natural vibration frequency decreases.

The centrifugal stress can be suppressed from increasing by, for example, an optimum distribution of the cross-sectional area of blades or provision of high strength to and weight reduction of the blade material. For example, the structure of the moving blade is devised in various ways for vibration characteristics, such that various characteristic values of the moving blades or moving blade group, which appear when the moving blades are made long, are detuned sufficiently relative to an operation frequency.

When the long blades are provided as independent blades, the detuning becomes difficult because characteristic values lie in various modes and frequencies. In response to the above, it is often that the moving blades of the entire annular circumference are determined as one group by forming a protruded portion on the moving blade tip portion to contact with the adjacent moving blade or using a connection part at the moving blade tip portion. In addition, there is a disclosed technology that the vibration characteristics are improved by disposing the same structure as that of the tip portion at an intermediate portion of the span from the blade root portion to the tip portion of the moving blade.

Especially, in a case where the connection structure is disposed at the span intermediate portion of the moving blade, the shape of the turbine moving blade cascade which is originally designed to suppress an aerodynamic loss as much as possible is deformed considerably or a resistance element is disposed in the flow passage between the moving blades. Therefore, it is obvious that the above situation becomes a factor of degrading the stage performance of the steam turbine. And, the suppression of the performance degradation is an issue to prove a highly efficient steam turbine.

Meanwhile, there is a disclosed technology that in a fluid machine using titanium having high strength, namely so-called specific strength, against the specific gravity of the material, as a material for the moving blade, a stress and a fluid resistance are reduced by having a pin which is small in mass and three-dimensional size as an intermediate connecting member. There is also a disclosed technology that an aerodynamic loss is reduced by having an airfoil shape for the intermediate connecting member of the fan moving blades. In addition, there is a disclosed technology that an aerodynamic loss is reduced by having a streamline-shape for the intermediate connecting member of the moving blades of the steam turbine.

FIG. 21A is a plan view showing a pressure side of a moving blade 300 of a conventional steam turbine. FIG. 21B is a plan view of a turbine moving blade cascade configured of the moving blades 300 shown in FIG. 21A seen from a radial outside. FIG. 21C is a view showing a V1-V1 cross section of FIG. 21B. The conventional turbine moving blade cascade shown here has the intermediate connecting member in a streamline-shape to reduce an aerodynamic loss.

FIG. 22A is a view illustrating a flow around a cylindrical intermediate connecting member 310 of the conventional turbine moving blade cascade provided with the intermediate connecting member 310. FIG. 22B is a view illustrating loss regions at a V2-V2 cross section of FIG. 22A. FIG. 23A is a view illustrating a flow around a streamline-shaped intermediate connecting member 301 at the conventional turbine moving blade cascade provided with the intermediate connecting member 301. FIG. 23B is a view illustrating loss regions at a V3-V3 cross section of FIG. 23A. FIG. 22B and FIG. 23B show the loss regions when the flows are observed from downstream sides at the individual cross sections. And, each two linear lines extended in a vertical direction shown in FIG. 22B and FIG. 23B indicate a trailing edge 300*a* of the moving blade.

The moving blade 300 shown in FIG. 21A is provided with the intermediate connecting member 301 on its suction and pressure sides as shown in FIG. 21B. The intermediate connecting member 301 has a streamline-shaped cross section as shown in FIG. 21C.

It is seen by comparing FIG. 22B and FIG. 23B that high-loss areas 320 expand largely due to twin vortices generated above and below the wake flow of the cylindrical intermediate connecting member 310. Meanwhile, the high-loss areas 320 decrease at the wake flow of the streamline-shaped intermediate connecting member 301 more than at the cylindrical intermediate connecting member 310, and low-loss areas 321 lie in a large area between the moving blades 300. It is seen from the above that the streamline-shaped intermediate connecting member 301 contributes to the reduction of an aerodynamic loss. But, the high-loss areas 320 have not disappeared completely, indicating that there is still scope for loss improvement.

Here, it is seen by observing the loss generating regions in detail relative to the moving blade 300 provided with the streamline-shaped intermediate connecting member 301 that they are deviated toward a suction side 300*b* of the moving blade 300 where the streamline-shaped intermediate connecting member 301 is connected. It is presumed to result from the generation of a low energy region when a boundary layer, which develops on the suction side 300*b* of the moving blade 300, crosses the leading edge portion of the intermediate connecting member 301. It is understood to be similar to a horseshoe vortex generated between the turbine moving blade cascades, and it is considered that the high-loss areas expand as the vortex develops in combination with the development of the boundary layer on the suction side surface having a continuous convex surface with respect to the flow. According to estimation such as numerical analysis, it is known that the stage efficiency might be lowered by several percent because of the above loss. For example, since an output sharing ratio to the entire steam turbine becomes 10% or more in the turbine stage provided with moving blades of long blade length in the steam turbine, the stage performance deterioration cannot be ignored.

As described above, when the intermediate connecting member is provided to improve, for example, the vibration characteristics of the moving blades which are long blades, it becomes a passage resistance against the steam flowing between the moving blades, and aerodynamic performance is lowered.

For example, when the intermediate connecting member is reduced in three-dimensional size in order to suppress the above, a risk of buckling distortion or breakage increases at the intermediate connecting member or the connection portion between the intermediate connecting member and the moving blade because a section modulus to an untwisting force of the blade is insufficient. And, in a case where the intermediate connecting member is configured into a streamline-shape, the high-loss area is not eliminated even if the streamline-shape is formed while member strength is secured.

DETAILED DESCRIPTION

In one embodiment, a turbine rotor assembly comprises a turbine rotor and a plurality of moving blades implanted in a circumferential direction of the turbine rotor. A flow passage is formed between each of the moving blades and a circumferentially adjacent moving blade. Each of the moving blades comprises a suction side connecting member protruded on a blade suction surface and a pressure side connecting member protruded on a blade pressure surface, wherein the suction side connecting member of each of the moving blades is configured to be connected with the pressure side connecting member of the circumferentially adjacent moving blade to form an intermediate connecting member between the moving blade and the circumferentially adjacent moving blade during a rotation of the turbine rotor. A downstream side end edge of the intermediate connecting member is positioned at an upstream side of a throat portion of the flow passage.

Embodiments of the present invention will be described below with reference to the drawings.

Figure 1:
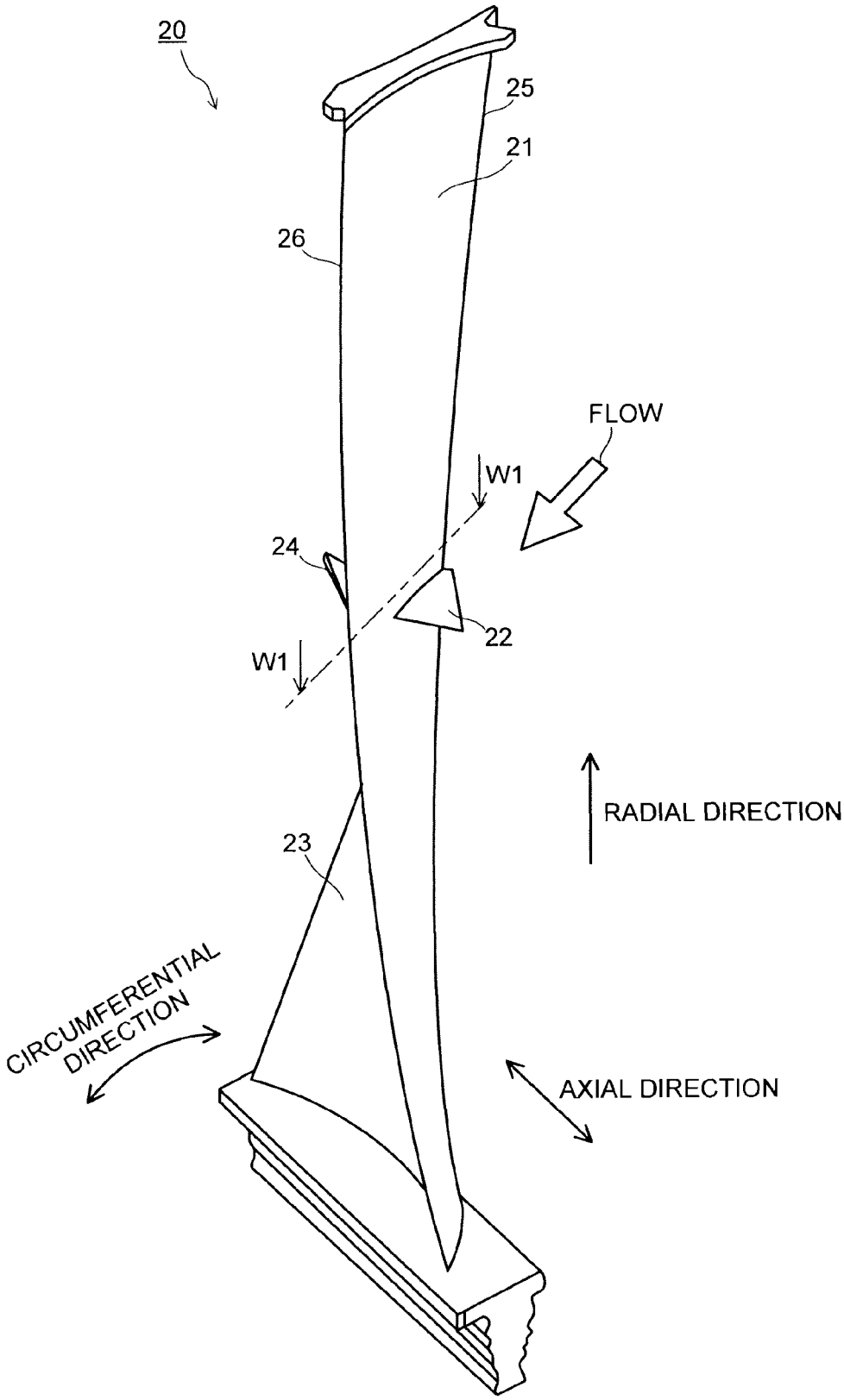
FIG. 1 is a perspective view of a moving blade configuring a turbine rotor assembly according to one embodiment of the invention.
Figure 2:
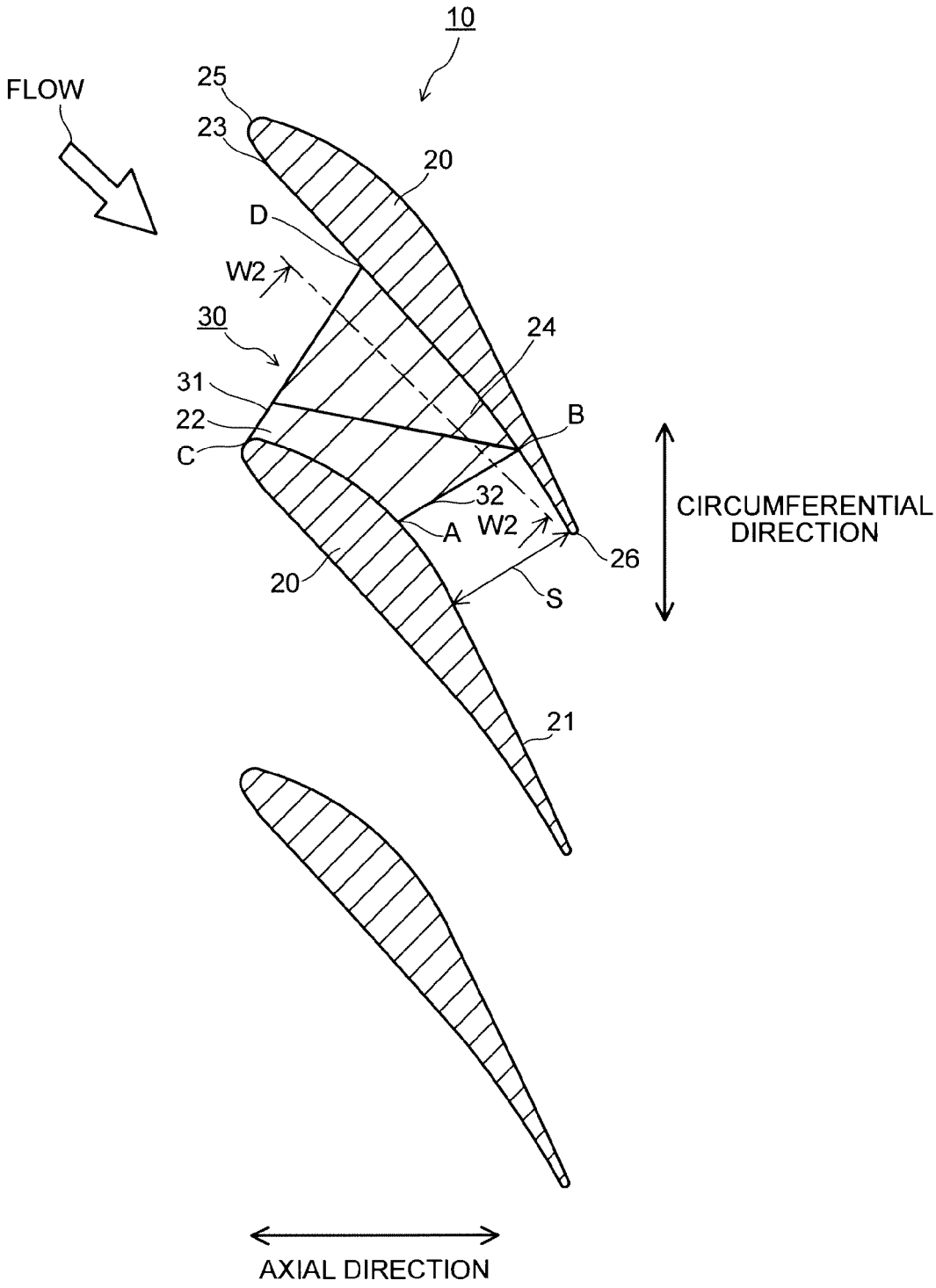
FIG. 2 is a sectional view showing the turbine moving blade of the turbine rotor assembly according to the embodiment of the invention taken along a line W1-W1 shown in FIG. 1.

FIG. 1 is a perspective view of a moving blade 20 configuring a turbine rotor assembly 10 according to one embodiment of the invention. FIG. 2 is a sectional view showing the turbine moving blade of the turbine rotor assembly 10 according to the embodiment of the invention taken along the line W1-W1 shown in FIG. 1.

As shown in FIG. 1 and FIG. 2, the turbine rotor assembly 10 comprises a turbine rotor (not shown) and a plurality of moving blades 20 implanted in a circumferential direction of the turbine rotor. Each of the moving blades 20 comprises a blade suction side surface and a blade pressure side surface. A flow passage is formed between the moving blade 20 and a circumferentially adjacent moving blade 20. A suction side connecting member 22 and a pressure side connecting member 24 are protruded on a blade suction surface 21 and a blade pressure surface 23, respectively.

As shown in FIG. 2, when the moving blades 20 rotate during a rotation of the turbine blade assembly 10, the suction side connecting member 22 and the pressure side connecting member 24 of the circumferentially adjacent moving blades 20 contact with each other and are connected to configure an intermediate connecting member 30. The contact surfaces of the suction side connecting member 22 and the pressure side connecting member 24 are configured to have the same shape.

The cross section of intermediate connecting member 30 in a direction of steam flow in the flow passage is preferably configured to have a streamline-shape, such as an airfoil shape, to suppress an aerodynamic loss. The turbine rotor assembly 10 is suitably applied to, for example, a turbine that have relatively longer blades such as last stage moving blades of a low pressure turbine to improve vibration characteristics of the turbine moving blades 20.

A general flow of a working fluid, such as steam, at the turbine rotor assembly 10 provided with the intermediate connecting member 30 is described below.

Figure 3:
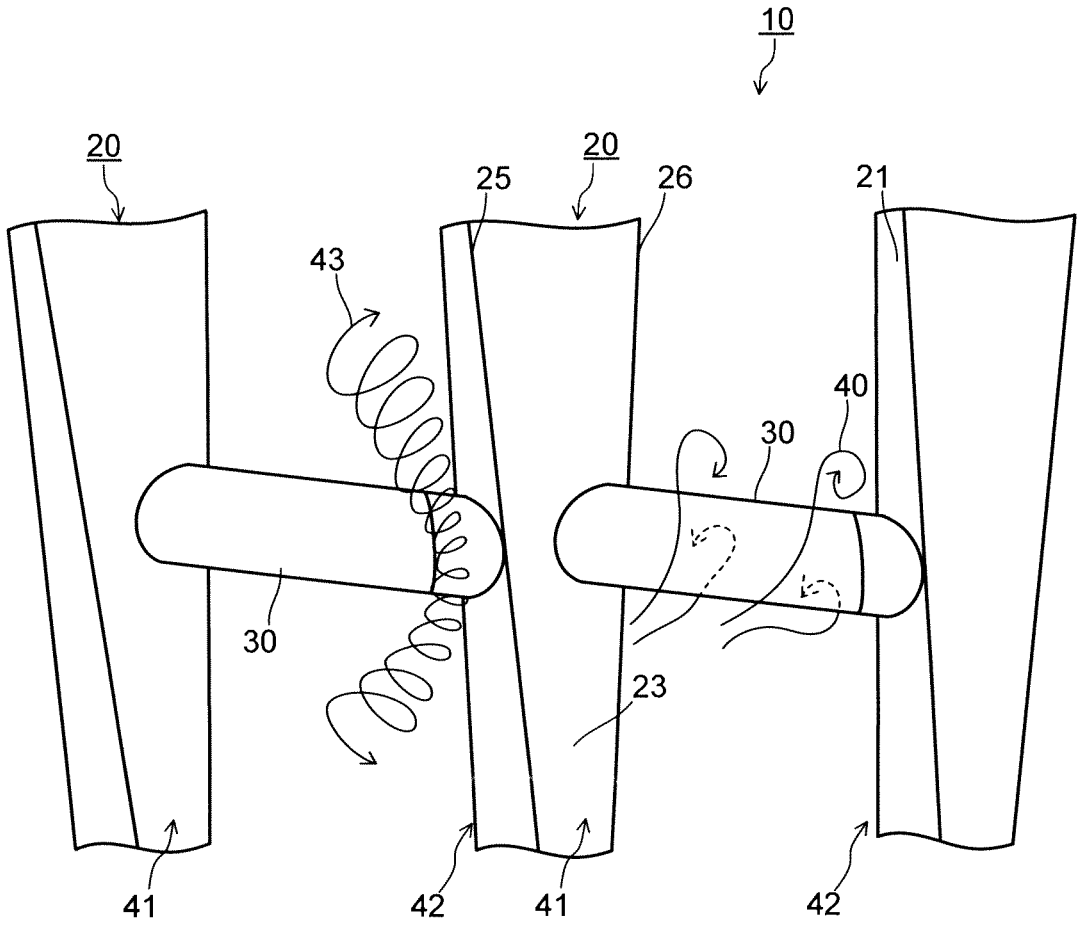
FIG. 3 is a view showing a flow between the moving blades seen from an upstream side of the flow according to one embodiment of the invention is seen from the upstream side.
Figure 4:
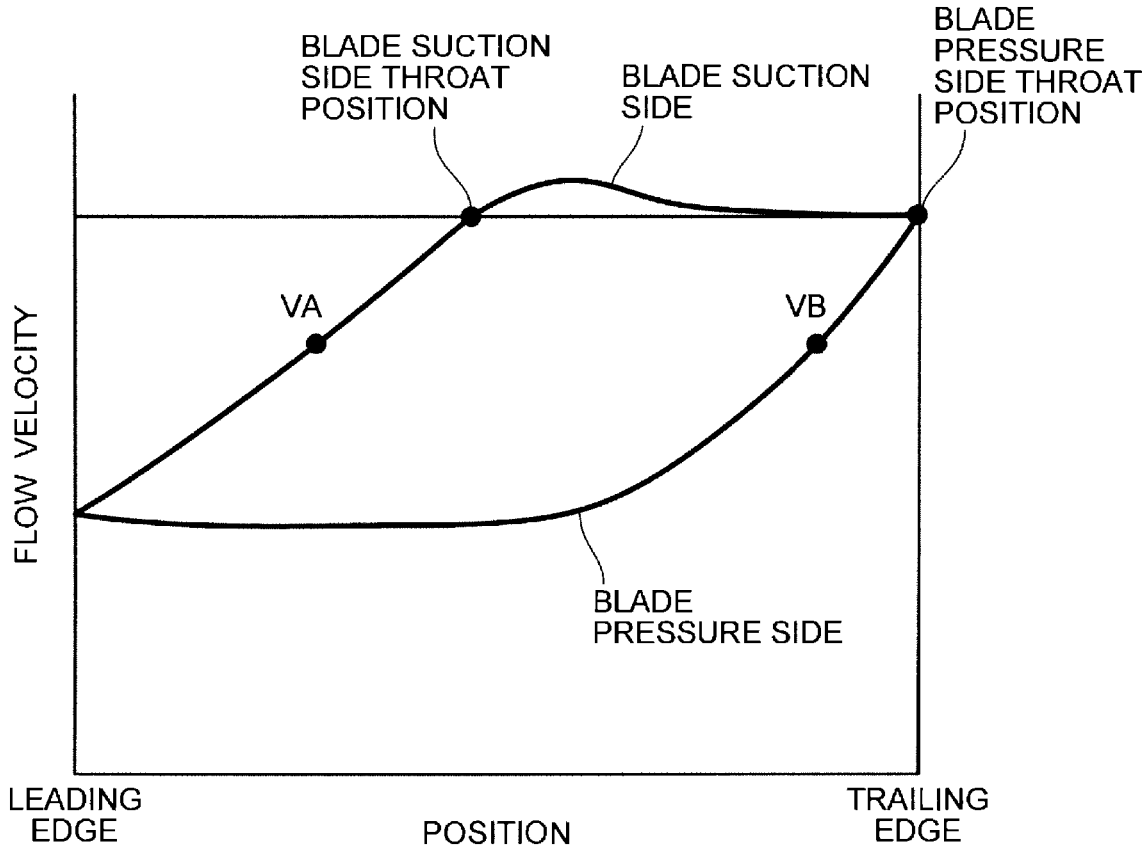
FIG. 4 is a view showing a general blade surface velocity distribution of the moving blade.
Figure 5:
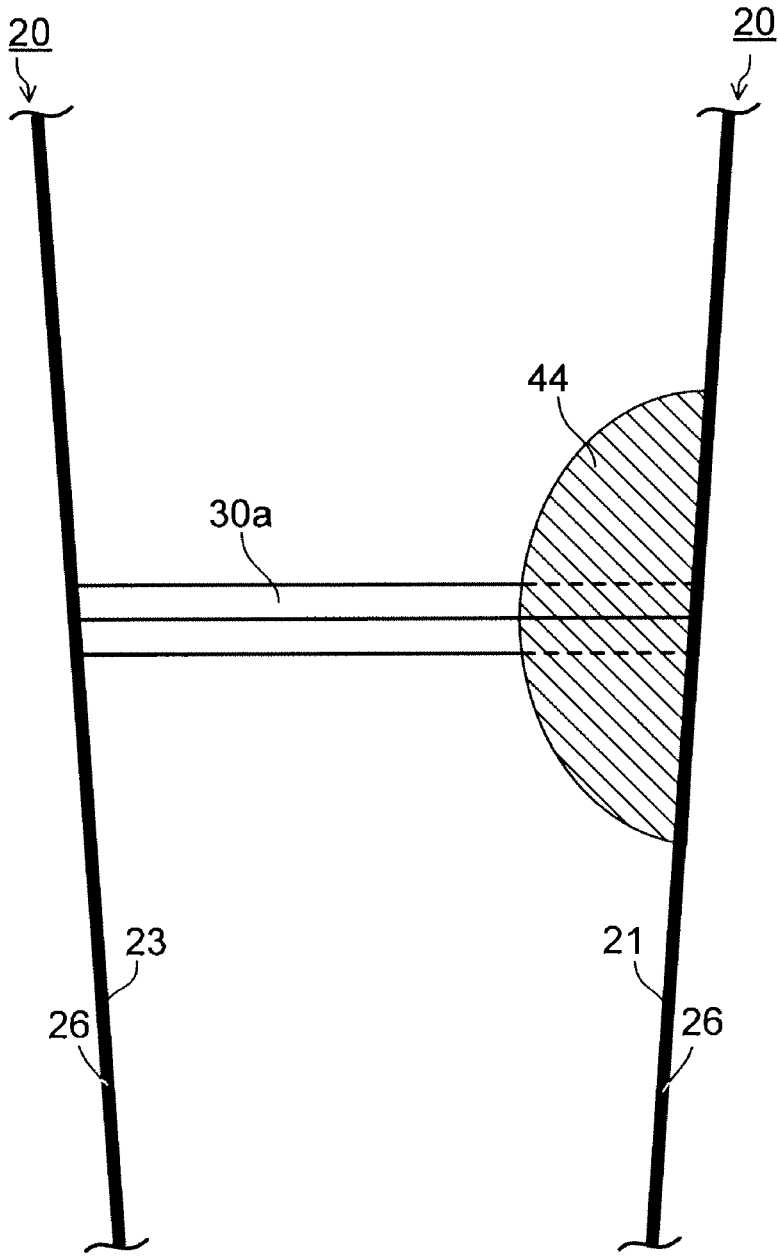
FIG. 5 is a view illustrating a high loss region at downstream of a general intermediate connecting member.

FIG. 3 is a view showing a flow between the moving blades 20 seen from an upstream side of the flow, including the intermediate connecting member 30. FIG. 4 is a view showing a general blade surface velocity distribution of the moving blade 20. FIG. 5 is a view illustrating a high loss region downstream of a general intermediate connecting member.

As shown in FIG. 3, the working fluid flowing into the turbine rotor assembly 10 forms a trailing vortex 40 when it flows around the intermediate connecting member 30 to pass through it. And, on a boundary layer of the moving blade surface, a velocity becomes zero on the moving blade surface and becomes a main flow velocity on the upper layer part of the boundary layer, and a blade pressure side boundary layer 41 and a blade suction side boundary layer 42 having a large vorticity pass through the intermediate connecting member 30 by flowing around it. Thus, a horseshoe vortex 43 is generated downstream of the intermediate connecting member 30.

The trailing vortex 40 and the horseshoe vortex 43 develop together, but their rate of development is different on the blade suction side and the blade pressure side. In the turbine rotor assembly 10, the blade suction surface 21 of the moving blade 20 has a curvature larger than that of the blade pressure surface 23 as shown in FIG. 2. Therefore, the boundary layer tends to develop at the blade suction surface 21 of the moving blade 20, and the flow tends to separate.

The blade surface velocity distribution of the moving blade 20 is described below with reference to FIG. 4. VA and VB shown in FIG. 4 are described later. As shown in FIG. 4, a flow velocity from a leading edge 25 to a trailing edge 26 of the moving blade 20 accelerates toward downstream of a throat S and then decelerates on the blade suction side. Meanwhile, since the trailing edge 26 becomes the throat S on the blade pressure side, the acceleration continues monotonically. Therefore, the development of the trailing vortex 40 and the horseshoe vortex 43 is assisted by passing through a deceleration area on the blade suction side but suppressed on the blade pressure side because they are always in an acceleration area.

Here, the throat S means a cross section of the flow passage, meaning a cross section perpendicular to the direction of the flow, where an area of the flow passage, that the working fluid flows, becomes minimum between the moving blades 20. In the cross section shown in FIG. 2, for example, the throat S has a width where the distance from the trailing edge 26 of the moving blade 20 to the blade suction surface 21 of the adjacent moving blade 20 becomes shortest. This throat width is variable depending on a cross-sectional position. In FIG. 2, the throat S is indicated by an arrow for convenience of explanation (the same is applied hereinbelow).

At a general intermediate connecting member 30*a*, a vortex region, which develops downstream of the intermediate connecting member 30*a*, is biased as shown in FIG. 5, and a high loss region 44 developed on the blade suction side is formed because a flow area is different between the blade suction side and the blade pressure side.

Accordingly, the intermediate connecting member 30 in the turbine rotor assembly 10 according to one embodiment of the invention is configured such that a downstream side end edge 32 of the intermediate connecting member 30 is located at the upstream side of the throat S, namely at the leading edge side of the moving blade 20, as shown in FIG. 2. In FIG. 2, the point where the downstream side end edge 32 of the intermediate connecting member 30 intersects the blade suction surface 21 of the moving blade 20 is A, the point where the downstream side end edge 32 of the intermediate connecting member 30 intersects the blade pressure surface 23 of the moving blade 20 is B, the point where an upstream side end edge 31 of the intermediate connecting member 30 intersects the blade suction surface 21 of the moving blade 20 is C, and the point where the upstream side end edge 31 of the intermediate connecting member 30 intersects the blade pressure surface 23 of the moving blade 20 is D.

In a case where the intermediate connecting member 30 is configured to have an airfoil shape, the downstream side end edge 32 corresponds to the trailing edge, and the upstream side end edge 31 corresponds to the leading edge. As shown in FIG. 2, the throat S is formed in a region ranging from the trailing edge 26 of the moving blade 20 to the blade suction surface 21 of the adjacent moving blade 20.

FIG. 4 shows a flow velocity VA at the point A where the downstream side end edge 32 of the intermediate connecting member 30 intersects the blade suction surface 21 of the moving blade 20 in the turbine rotor assembly 10 of one embodiment and a flow velocity VB at the point B where the downstream side end edge 32 of the intermediate connecting member 30 intersects the blade pressure surface 23 of the moving blade 20. As shown in FIG. 4, the points A and B are located within the acceleration area.

Thus, the downstream side end edge 32 of the intermediate connecting member 30 is located at the upstream side of the throat S, so that the downstream side end edge 32 of the intermediate connecting member 30 can also be laid in the acceleration area on the blade suction side of the moving blade 20. Accordingly, a vortex can be suppressed from developing downstream of the intermediate connecting member 30. In addition, the high loss region 44 which is formed on the blade suction side downstream of the general intermediate connecting member 30*a* can be suppressed as shown in FIG. 5.

It is preferable as shown in FIG. 2 that the suction side connecting member 22 of the moving blade 20 is formed from the leading edge 25 to the trailing edge of the moving blade 20 along the blade suction surface of the moving blade 20. Here, the point C where the upstream side end edge 31 of the intermediate connecting member 30 intersects the blade suction surface 21 of the moving blade 20 is the leading edge 25 of the moving blade 20.

When the moving blades 20 rotate, a compression stress and a bending stress are applied to the intermediate connecting member 30, and to withstand them, it is preferable that for example, the suction side connecting member 22 has a large cross-sectional area on the boundary surface between the blade suction surface 21 of the moving blade 20 and the suction side connecting member 22. And, to increase the cross-sectional area, it is preferable in view of reduction of an aerodynamic loss that the distance from the point A to the point C (hereinafter referred to as chord length AC) is determined as maximum, and the thickness of the suction side connecting member 22 to the length of the suction side connecting member 22 in a direction along the flow is minimized. Meanwhile, it is configured to locate the point A, which is on the blade suction surface 21 of the moving blade 20, at the upstream side of the throat S. Accordingly, the chord length AC can be maximized by determining the point C at the leading edge 25 of the moving blade 20 as described above.

The cross-sectional shape from the blade suction surface 21 to the blade pressure surface 23 of the intermediate connecting member 30 is not required to be constant. For example, if strength becomes insufficient when the distance from the point B to the point D (hereinafter referred to as chord length BD) in which the pressure side connecting member 24 is formed is made equal to the chord length AC, the pressure side connecting member 24 may be formed such that the chord length BD becomes longer than the chord length AC. In such a case, the contact surfaces of the suction side connecting member 22 and the pressure side connecting member 24 are also configured to have the same shape as described above.

Figure 6:
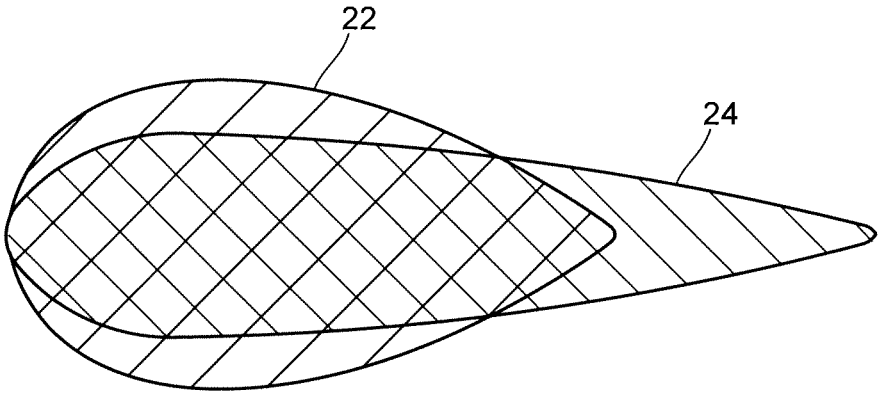
FIG. 6 is a view showing an example of a cross-sectional shape on a boundary surface between a moving blade surface and the pressure and suction side connecting members according to one embodiment of the invention.
Figure 7:
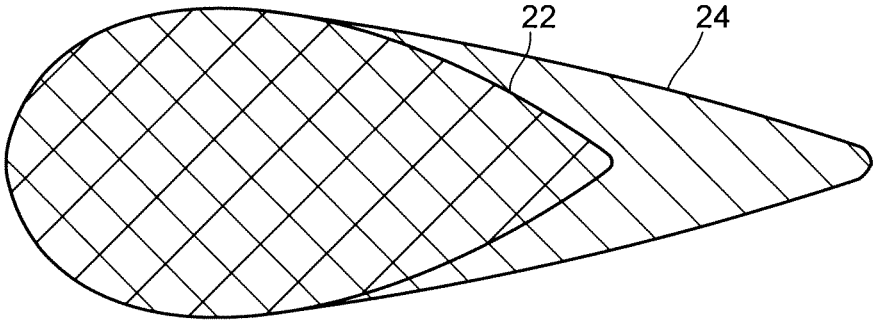
FIG. 7 is a view showing an example of a cross-sectional shape on a boundary surface between a moving blade surface and the pressure and suction side connecting members according to one embodiment of the invention.

FIG. 6 and FIG. 7 show examples of cross-sectional shapes of the suction side connecting member 22 and the pressure side connecting member 24 on the boundary surface with respect to the moving blade surface when they are formed such that the chord length BD becomes longer than the chord length AC. Here, the intermediate connecting member 30 is determined to have an airfoil shape. And, the connecting members are formed such that the suction side connecting member 22 continuously changes the cross-sectional shape toward the pressure side connecting member 24, and the pressure side connecting member 24 continuously changes the cross-sectional shape toward the suction side connecting member 22.

FIG. 6 shows an example that the cross-sectional areas of the suction side connecting member 22 and the pressure side connecting member 24 on the boundary surface with the moving blade surfaces are made equal. By configuring in this way, the thickness of the pressure side connecting member 24 on the boundary surface with respect to the blade pressure surface 23 can be reduced, so that the aerodynamic loss on the blade pressure side can be reduced.

FIG. 7 is an example that the suction side connecting member 22 and the pressure side connecting member 24 are made to have the same maximum thickness on the boundary surface with the moving blade surface. By configuring in this way, a ratio of the distance from the leading edge indicating the maximum thickness with respect to the distance (chord length) from the leading edge to the trailing edge can be made small, so that the profile loss due to the airfoil shape of the intermediate connecting member 30 can be reduced. The reason will be described later.

(Another Shape of the Intermediate Connecting Member 30)

The shape of the intermediate connecting member 30 is not limited to the one shown in FIG. 2 but may have another shape.

Figure 8:
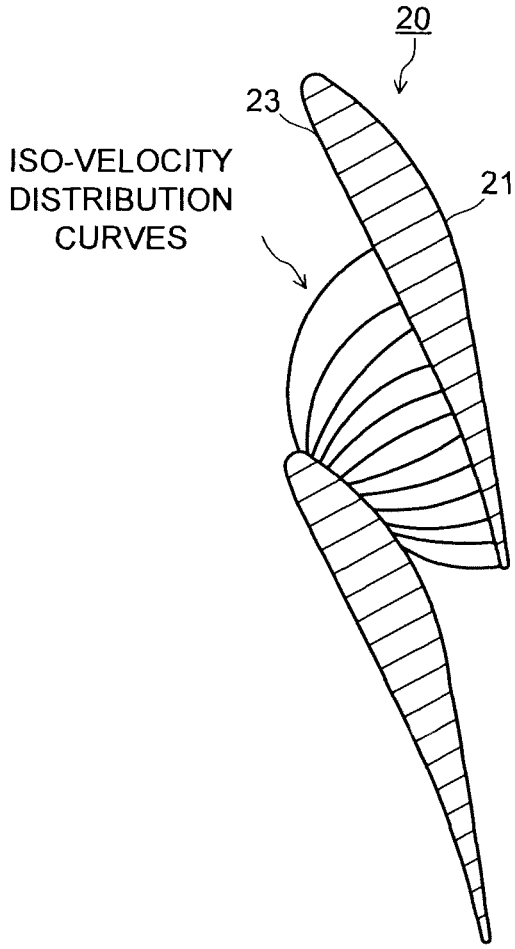
FIG. 8 is a view showing typical iso-velocity distribution curves at a relatively outward position between the moving blades having long blade length.
Figure 9:
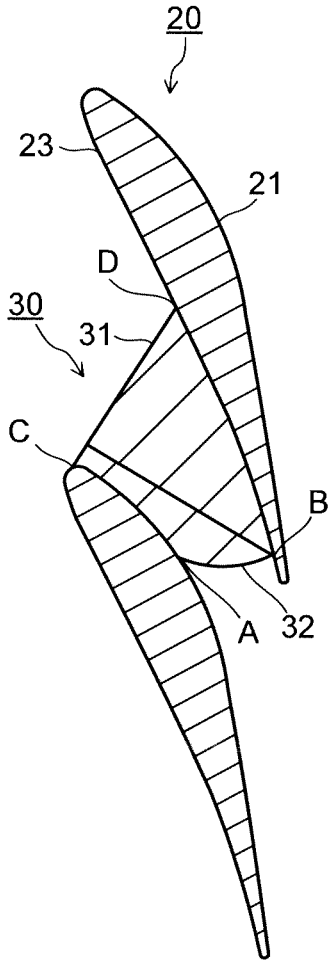
FIG. 9 is a view showing a shape of a different intermediate connecting member in a cross section corresponding to the W1-W1 cross section shown in FIG. 1 according to one embodiment of the invention.
Figure 10:
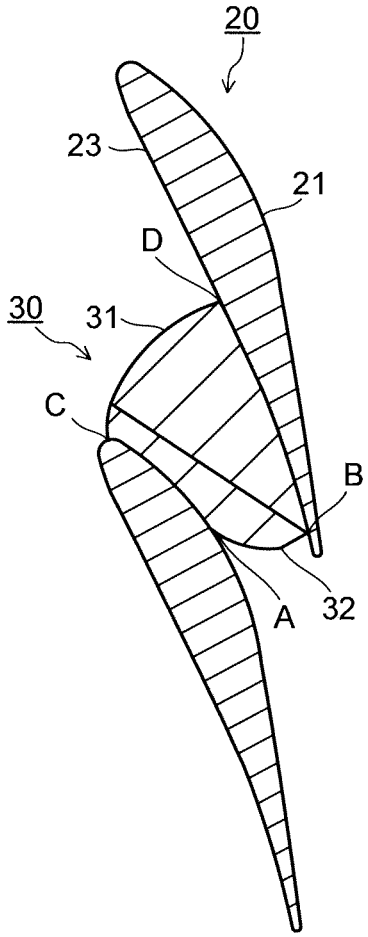
FIG. 10 is a view showing a shape of a different intermediate connecting member in a cross section corresponding to the W1-W1 cross section shown in FIG. 1 according to one embodiment of the invention.

FIG. 8 is a view showing typical iso-velocity distribution curves at a relatively outward position in the radial direction between the moving blades having long blade length configuring the turbine moving blade cascade of the turbine rotor assembly. FIG. 9 and FIG. 10 are views showing a shape of a different intermediate connecting member 30 in a cross section corresponding to the W1-W1 cross section shown in FIG. 1.

As shown in FIG. 8, the iso-velocity distribution curves have non-dense intervals from upstream to downstream on the blade pressure side, and acceleration is moderate, while the iso-velocity distribution curves have dense intervals on the blade suction side, and acceleration is rapid. Therefore, the iso-velocity distribution curves are curved from the blade pressure side toward the blade suction side.

The intermediate connecting member 30 shown in FIG. 9 is determined to have its downstream side end edge 32 in a shape formed along the iso-velocity distribution curves and curved toward the upstream side of the blade suction side. In this case, the downstream side end edge 32 of the intermediate connecting member 30 is protruded toward the downstream side from the straight line connecting the point A and the point B. And, the downstream side end edge 32 of the intermediate connecting member 30 is also located upstream of the throat S.

By configuring the intermediate connecting member 30 as described above, a secondary flow from the blade pressure side toward the blade suction side on the surface of the intermediate connecting member 30 can be controlled, and the trailing vortex 40 and the horseshoe vortex 43 which are generated downstream of the intermediate connecting member 30 can be suppressed from developing.

Similar to the intermediate connecting member 30 shown in FIG. 9, the intermediate connecting member 30 shown in FIG. 10 has its downstream side end edge 32 in a shape formed along the iso-velocity distribution curves and its upstream side end edge 31 in a shape formed along the iso-velocity distribution curves. In this case, the upstream side end edge 31 of the intermediate connecting member 30 is protruded toward the upstream side from the straight line connecting the point C and the point D.

The structure of the above intermediate connecting member 30 is preferable when it is necessary to increase the area of the contact surface in order to secure strength when, for example, the suction side connecting member 22 and the pressure side connecting member 24 are contacted to each other. And, since the upstream side end edge 31 of the intermediate connecting member 30 can minimize the disturbance applied to smooth acceleration of the fluid between the original blade cascades, performance deterioration due to an aerodynamic loss or the like can be suppressed.

(Cross-Sectional Shape of the Intermediate Connecting Member 30)

A cross-sectional shape of the intermediate connecting member 30 is described below.

Figure 11:
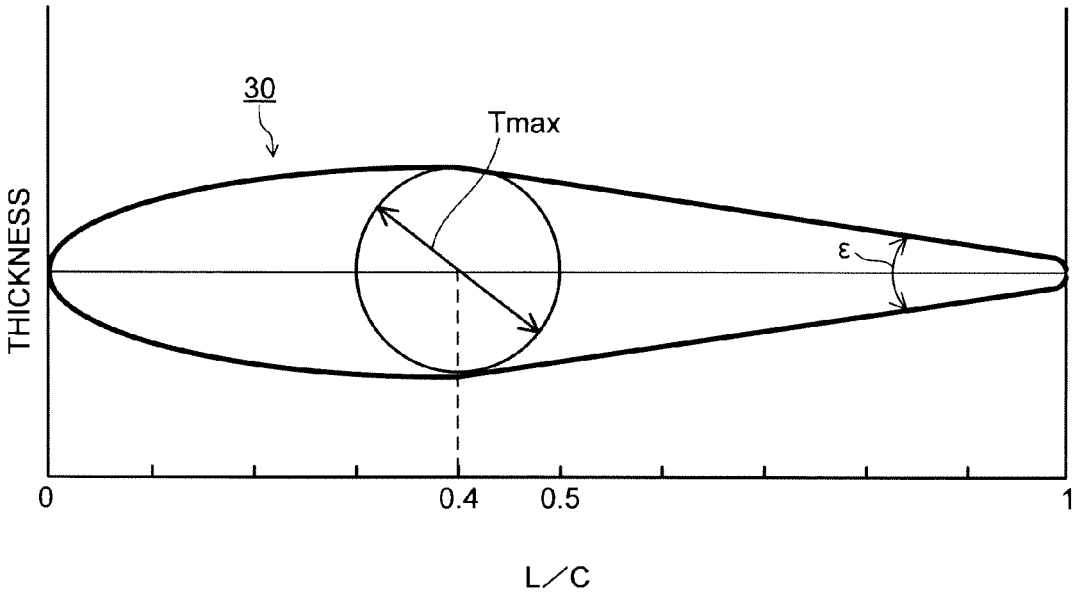
FIG. 11 is a view showing a position of the maximum thickness (Tmax) of an intermediate connecting member on a W2-W2 cross section of FIG. 2.

FIG. 11 is a view showing a position of the maximum thickness (Tmax) of the intermediate connecting member 30 on the W2-W2 cross section of FIG. 2. The horizontal axis of FIG. 11 indicates a ratio (L/C) of a distance L, which is from the leading edge where the thickness of the intermediate connecting member 30 becomes maximum, to a distance (chord length) C which is from the upstream side end edge 31 (leading edge) to the downstream side end edge 32 (trailing edge) of the intermediate connecting member 30.

As shown in FIG. 11, the intermediate connecting member 30 is formed to have a streamline-shape that has the maximum thickness (Tmax) at a position in a prescribed range from the leading edge to the trailing edge and suppresses the fluid resistance. And, the prescribed range in which the intermediate connecting member 30 has the maximum thickness (Tmax) is preferably determined to be a position where the L/C becomes 0.4 or less.

The description below is the reason why it is desirable to configure the intermediate connecting member 30 such that the maximum thickness (Tmax) of the intermediate connecting member 30 lies at the position where the L/C becomes 0.4 or less.

Figure 12:
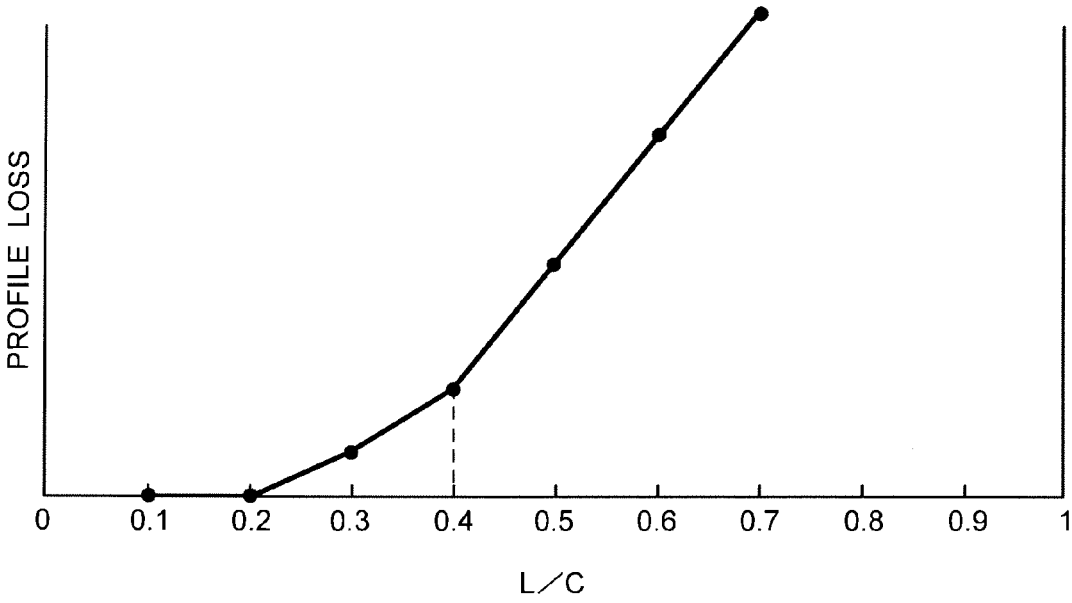
FIG. 12 is a graph showing a relationship between the position of the maximum thickness (Tmax) of the intermediate connecting member and a profile loss.

FIG. 12 is a view showing a relationship between a profile loss and a position of maximum thickness (Tmax) of the intermediate connecting member 30. Similar to the horizontal axis of FIG. 11, the horizontal axis of FIG. 12 indicates a ratio (L/C) of a distance L, which is from the leading edge where the thickness of the intermediate connecting member 30 becomes maximum, to a distance (chord length) C which is from the upstream side end edge 31 to the downstream side end edge 32 of the intermediate connecting member 30. The profile loss shown in FIG. 12 is a result obtained by computational fluid analysis. And, the profile loss when the L/C becomes 0.2 is determined as a standard in FIG. 12.

As shown in FIG. 12, the profile loss increases sharply when the L/C exceeds 0.4. When the L/C increases, an angle $\epsilon$ (hereinafter referred to as a wedge angle $\epsilon$) between one surface and the other surface of the intermediate connecting member 30 at the trailing edge increases as shown in FIG. 11.

It is considered from the result that when the maximum thickness (Tmax) of the intermediate connecting member 30 lies at a position where the L/C exceeds 0.4, the working fluid flows along the surface of the intermediate connecting member 30 on the side where the L/C is smaller than 0.4 (the upstream side having the maximum thickness (Tmax)), but the wedge angle $\epsilon$ increases on the downstream side, and the flow cannot follow an abrupt reduction in blade thickness and a curvature change, so that separation is caused, and the profile loss increases abruptly.

To suppress the abrupt reduction in blade thickness, the wedge angle $\epsilon$ may be decreased by increasing the thickness of the trailing edge, but it is not effective because the wake width of the wake flow at the trailing edge increases.

Therefore, the intermediate connecting member 30 is configured such that the maximum thickness (Tmax) of the intermediate connecting member 30 lies at a position where the L/C becomes 0.4 or less.

(Formation Angle of the Intermediate Connecting Member 30)

The angle of forming the intermediate connecting member 30 on the blade surface of the moving blade 20 is described below.

Figure 13:
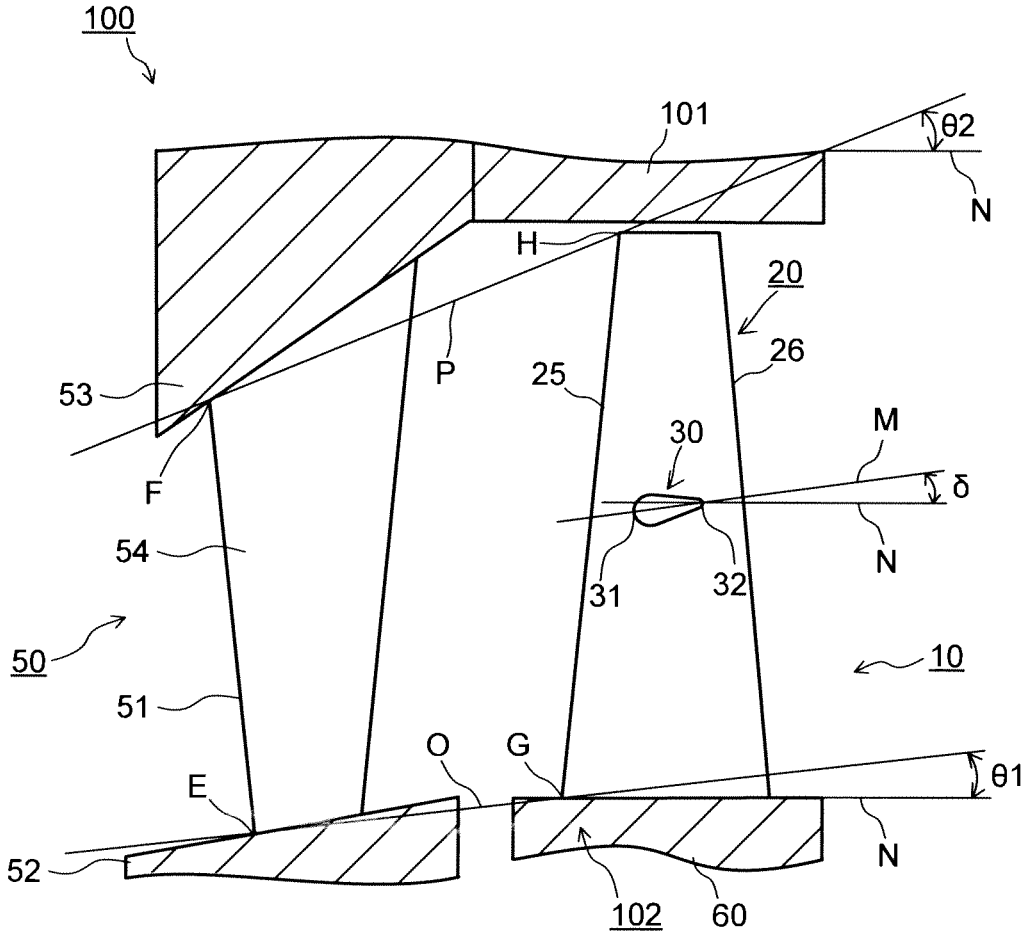
FIG. 13 is a cross sectional view showing a steam turbine including a turbine nozzle diaphragm and a turbine rotor assembly in a meridian plane along the center axis of a turbine rotor according to one embodiment of the invention.
Figure 14:
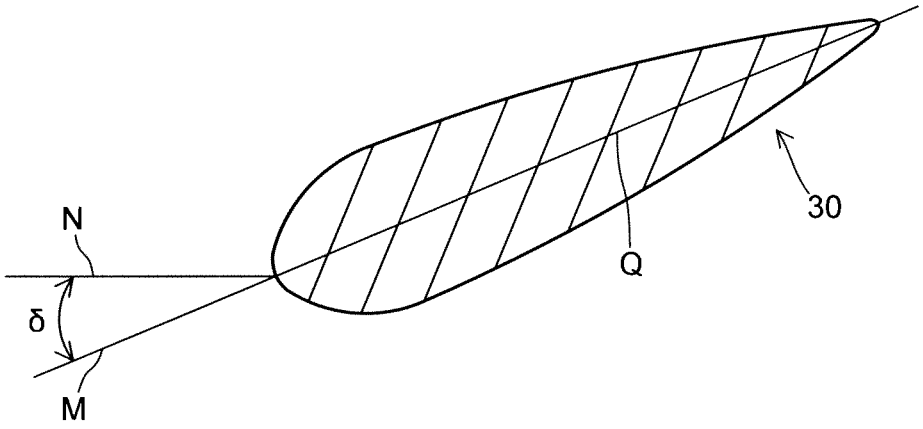
FIG. 14 is a cross sectional view showing a cross section of an intermediate connecting member according to one embodiment of the invention.
Figure 15:
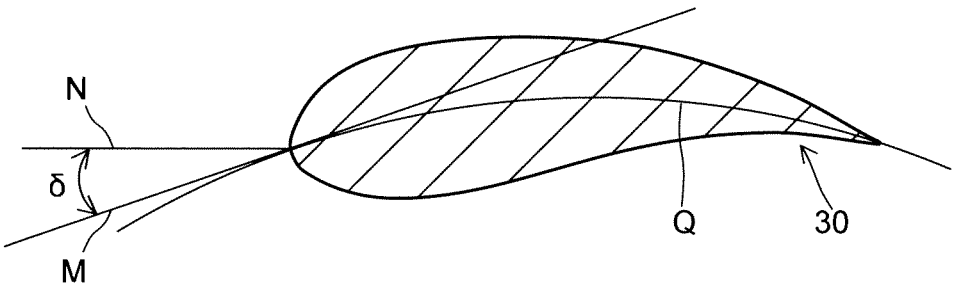
FIG. 15 is a cross sectional view showing a cross section of the intermediate connecting member according to one embodiment of the invention.

FIG. 13 is a cross sectional view showing a steam turbine including a turbine nozzle diaphragm and a turbine moving rotor assembly in a meridian plane along the center axis of the turbine rotor. FIG. 14 and FIG. 15 are cross sectional views showing cross sections of the intermediate connecting member 30 from the upstream side end edge 31 to the downstream side end edge 32. Referring to FIGS. 14 and 15, an angle $\delta$ between a straight line N parallel to the central axial direction of the turbine rotor and a tangent line M of a camber line Q at the upstream side end edge 31 of the intermediate connecting member 30 is described.

As shown in FIG. 13, a steam turbine 100 comprises a turbine casing 101 and a turbine rotor assembly 10. Turbine casing 101 constitutes stationary part of the steam turbine, with a nozzle diaphragm 50. Nozzle diaphragm 50, which is provided and secured to turbine casing 101, comprises a diaphragm inner ring 52, a diaphragm outer ring 53 and a plurality of nozzles 54. Nozzles 54 are circumferentially provided between diaphragm inner ring 52 and diaphragm outer ring 53. Turbine rotor assembly 10 comprises a turbine rotor 102 and a plurality of moving blades 20 that are circumferentially implanted on the outer surface of turbine rotor 102. Plurality of moving blades 20 circumferentially arranged as a whole form a moving blade cascade. Turbine rotor assembly 10 is rotatably provided inside turbine casing 101, so that the moving blade cascade is located at a downstream side of nozzle diaphragm 50. Nozzle diaphragm 50 and the moving blade cascade constitute a turbine stage. Steam turbine 100 may comprise a plurality of the turbine stages. In FIG. 13, the angle which is formed between the tangent line M of the camber line at the upstream side end edge 31 of the intermediate connecting member 30 and the straight line N parallel to the central axial direction of the turbine rotor is determined to be $\delta$ (degree). As shown in FIG. 14 and FIG. 15, the camber line Q is variable depending on the shape of the intermediate connecting member 30.

As shown in FIG. 13, it is determined that the straight line running through a crossing point E between a leading edge 51 of the nozzle 54 configuring the same turbine stage as that of the moving blade 20 and a diaphragm inner ring 52 for fixing the nozzles 54 and a crossing point G between the leading edge 25 of the moving blade 20 and a rotor disc 60 (turbine rotor 102) where the moving blades 20 are implanted is a straight line O, and the angle formed between the straight line O and the straight line N parallel to the central axial direction of the turbine rotor is $\theta 1$ (degree). In addition, it is determined that a straight line running through a crossing point F between the leading edge 51 of the nozzles 54 and a diaphragm outer ring 53 for fixing the nozzles 54 and a leading edge H at a tip of the moving blade 20 is a straight line P, and an angle between the straight line P and the straight line N parallel to the central axial direction of the turbine rotor is $\theta 2$ (degree).

Here, the intermediate connecting member 30 is formed on the blade surface of the moving blade 20 to satisfy the relationship of the following expression (1).

$$(\theta 1+\theta 2)/2-30 \leq \delta \leq (\theta 1+\theta 2)/2+30 \qquad \text{expression (1)}$$

Figure 16:
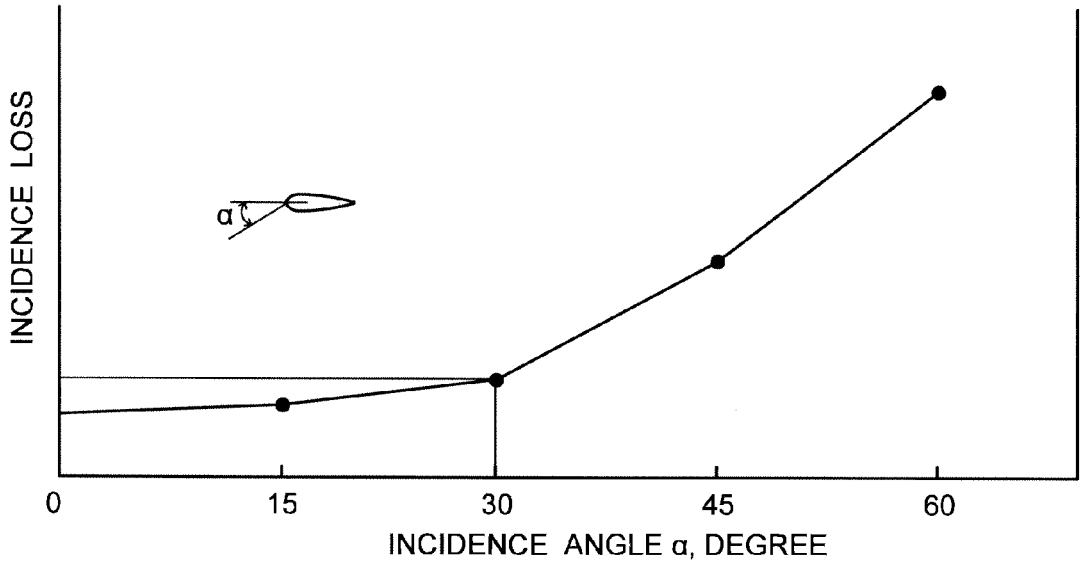
FIG. 16 is a graph showing a relationship between an incidence loss and an incidence angle $\alpha$ of a working fluid toward the intermediate connecting member.

The description below is the reason why it is preferable to form the intermediate connecting member 30 on the blade surface of the moving blade 20 to satisfy the relationship of the expression (1). FIG. 16 is a view showing a relationship between an incidence loss and an incidence angle $\alpha$ of the working fluid to the intermediate connecting member 30. The relationship between the incidence loss and the incidence angle $\alpha$ of the working fluid was obtained by computational fluid analysis.

It is often in a steam turbine that an enlargement ratio of an annular area of the flow passage is increased depending on an expansion rate of the working fluid in a turbine stage provided with moving blades which are long blades, and internal and external peripheral walls configuring the flow passage are formed to have an inclined shape as shown in FIG. 13. And, when the design is aerodynamically made appropriately, the flow is made along the internal and external peripheral walls. Meanwhile, the flow might not follow the shape as the enlargement ratio of the flow passage increases.

As to the relationship between the incidence angle $\alpha$ (degree) and the incidence loss, the incidence loss increases abruptly when the incidence angle $\alpha$ exceeds 30 degrees as shown in FIG. 16. Therefore, it is preferable that the intermediate connecting member 30 is formed on the blade surface of the moving blade 20 so that a deviation from a design inflow angle falls in a range of ±30 degrees. In other words, it is preferable to determine the angle $\delta$ such that a deviation from the design inflow angle, which is an average tilt ((θ1+θ2)/2) of the internal and external peripheral walls configuring the flow passage, falls in a range of ±30 degrees.

(Arrangement of the Intermediate Connecting Member 30)

In the above-described example, the suction side connecting member 22 and the pressure side connecting member 24 configuring the intermediate connecting member 30 each are formed on the blade suction surface 21 and the blade pressure surface 23 of the moving blade 20 at positions of the same radial distance (hereinafter referred to as radial position) from the central axis of the turbine rotor as shown in, for example, FIG. 1 but the above structure is not exclusively limited. The description below is an example that the suction side connecting member 22 and the pressure side connecting member 24 are formed at different radial positions of the blade suction surface 21 and the blade pressure surface 23 of the moving blade 20.

Figure 17:
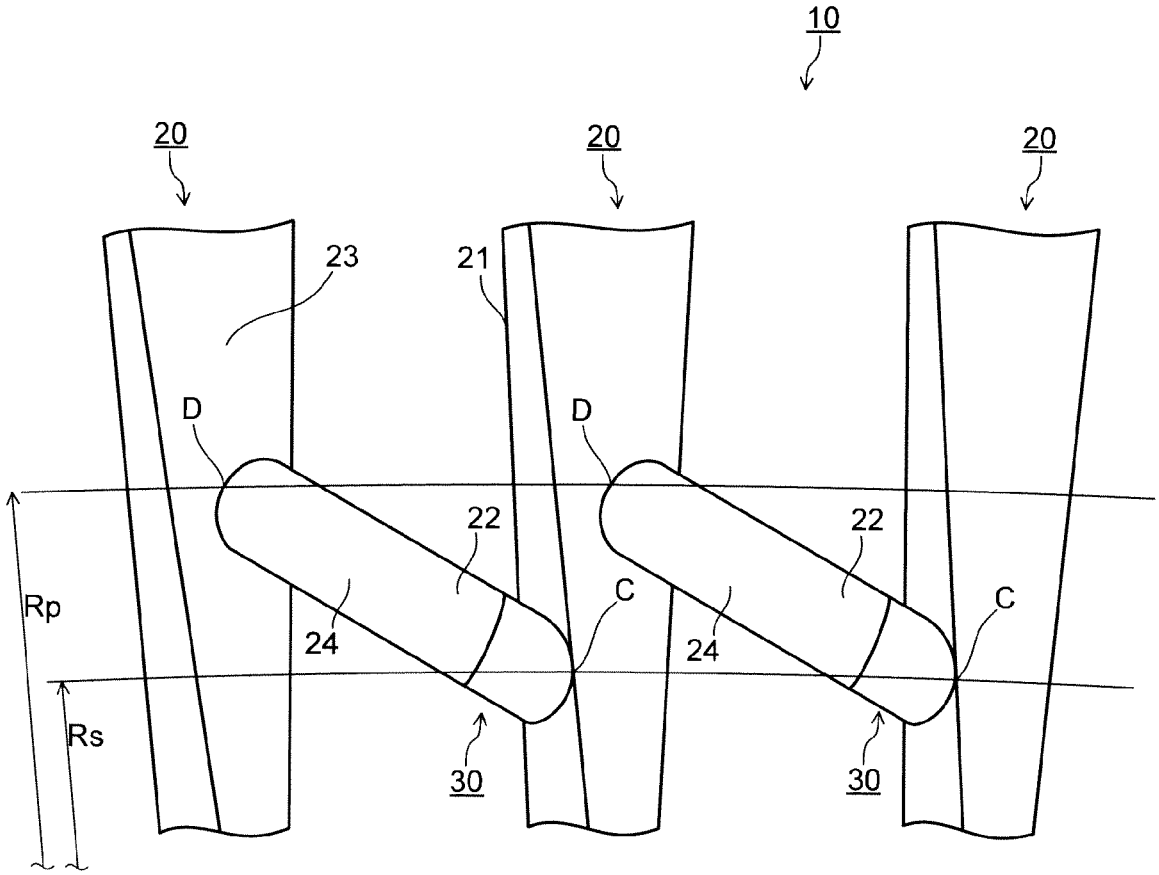
FIG. 17 is a plan view of the turbine moving blade cascade of the turbine rotor assembly seen from the upstream side according to one embodiment of the invention.
Figure 18:
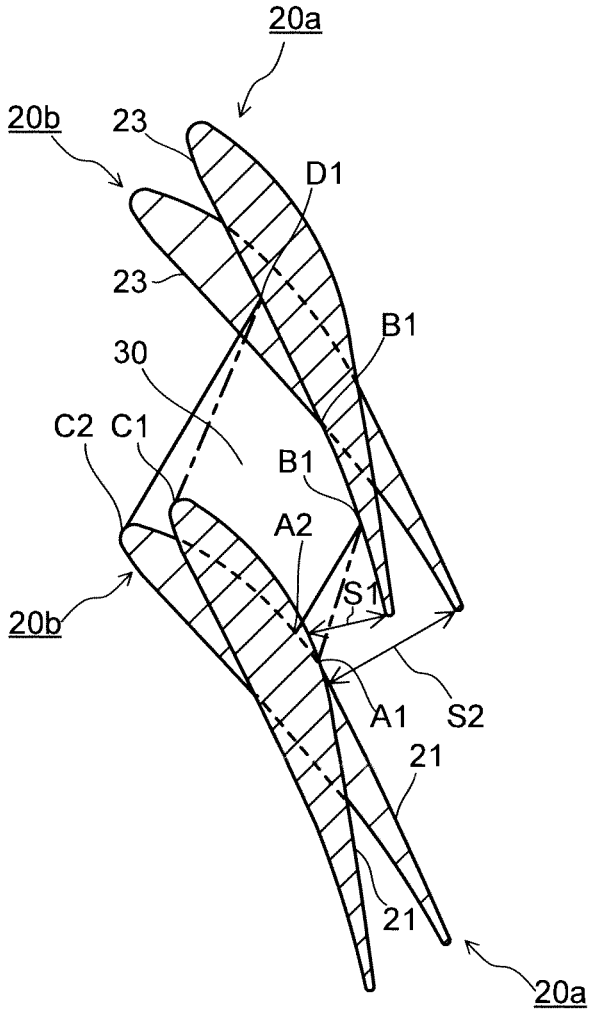
FIG. 18 is a plan view of the intermediate connecting member shown in FIG. 17 seen from a radial outside.

FIG. 17 is a plan view of the turbine rotor assembly 10 seen from the upstream side when the suction side connecting member 22 and the pressure side connecting member 24 are formed at different radial positions of the blade suction surface 21 and the blade pressure surface 23 of the moving blade 20. FIG. 18 is a plan view of the intermediate connecting member 30 of FIG. 17 as seen from a radial outside.

FIG. 18 is added with a superimposed view of cross sections of moving blades 20*a* and 20*b* at individual radial positions where the suction side connecting member 22 and the pressure side connecting member 24 are formed to clarify the position where the intermediate connecting member 30 is formed. FIG. 18 shows that a point of intersection between a downstream side end edge of the suction side connecting member 22 and the blade suction surface 21 of the moving blade 20 is A2, a point of intersection between a downstream side end edge of the pressure side connecting member 24 and the blade pressure surface 23 of the moving blade 20 is B1, a point of intersection between an upstream side end edge of the suction side connecting member 22 and the blade suction surface 21 of the moving blade 20 is C2, and a point of intersection between an upstream side end edge of the pressure side connecting member 24 and the blade pressure surface 23 of the moving blade 20 is D1. A throat S1 is a throat between the moving blades 20*a*, and a throat S2 is a throat between the moving blades 20*b*.

As shown in FIG. 17, the pressure side connecting member 24 has its leading edge formed at a radial position Rp, and the pressure side connecting member 24 is formed to have a predetermined inclination toward the suction side connecting member 22. Meanwhile, the leading edge of the suction side connecting member 22 is formed at a radial position Rs, and the suction side connecting member 22 is formed to have a predetermined inclination toward the pressure side connecting member 24. And, it is configured such that when the moving blades 20 rotate, the contact surfaces of the suction side connecting member 22 and the pressure side connecting member 24 are mutually contacted.

As shown in FIG. 18, the intermediate connecting member 30 is configured to have a shape connecting the point A2, point B1, point D1 and point C2.

Here, the shape of the moving blade 20*a* at the radial position Rp often has a short distance from the leading edge (point C1) to the throat S1 (throat between the moving blades 20*a*) in comparison with that of the shape of the moving blade 20*b* at the radial position Rs smaller than the radial position Rp. Therefore, when the intermediate connecting member 30 is configured between the moving blades 20*a* to have, for example, a shape (shape indicated by the broken line in FIG. 18) connecting the point A1 (the point where the downstream side end edge of the suction side connecting member 22 intersects the blade suction surface 21 of the moving blade 20 in this case), the point B1, the point D1 and the point C1, the point A1 is located downstream of the throat S1, so that the downstream side end edge 32 of the intermediate connecting member 30 is partly located downstream of the throat S1. Consequently, the above-described effect of suppressing the development of a vortex, which develops downstream of the intermediate connecting member 30, might be reduced.

Accordingly, the intermediate connecting member 30 is configured into the shape connecting the point A2, point B1, point D1 and point C2 similar to the above-described intermediate connecting member 30 shown in FIG. 17. Thus, the downstream side end edge 32 of the intermediate connecting member 30 can be located upstream of the throats S1 and S2. Therefore, the above-described effect of suppressing the development of a vortex, which develops downstream of the intermediate connecting member 30, can be obtained.

(Another Structure of the Intermediate Connecting Member 30)

The above-described intermediate connecting member 30 is an example of an intermediate connecting member 30 configured such that when the moving blades 20 rotate, the contact surfaces between the suction side connecting member 22 and the pressure side connecting member 24 are mutually contacted by untwisting of the blades, but the intermediate connecting member 30 is not limited to the above structure.

Figure 19:
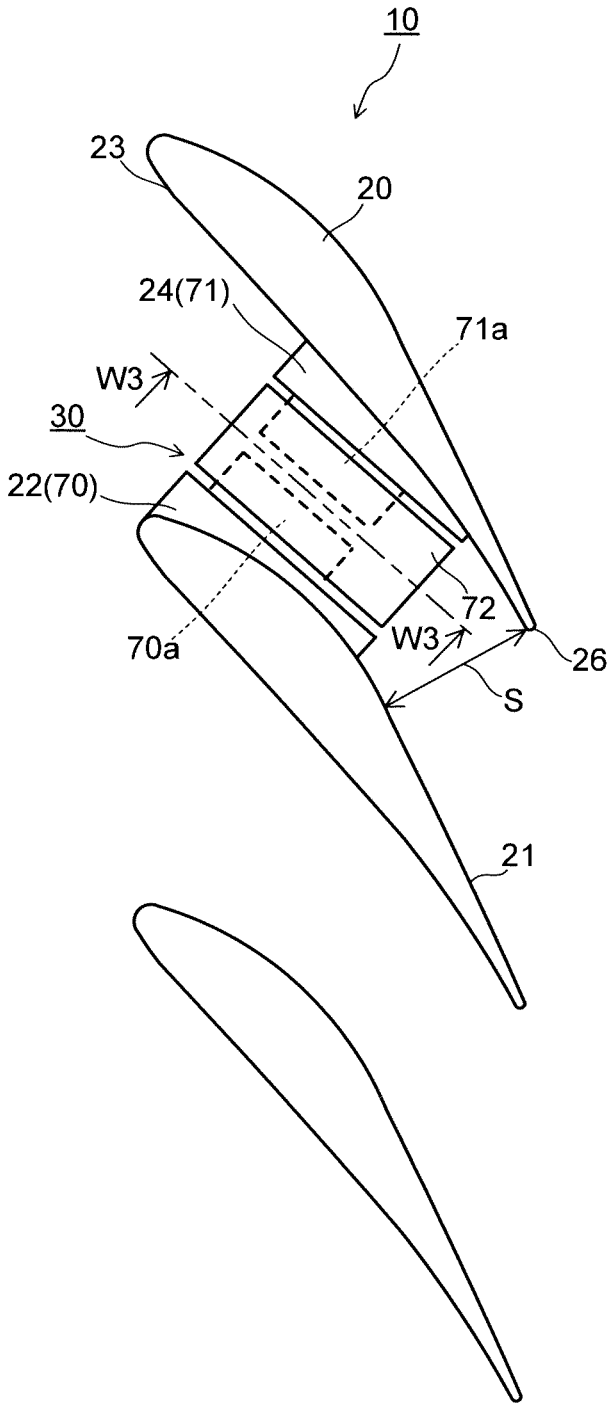
FIG. 19 is a plan view of a turbine moving blade cascade provided with an intermediate connecting member, having another structure according to one embodiment of the invention, seen from a radial outside.
Figure 20:
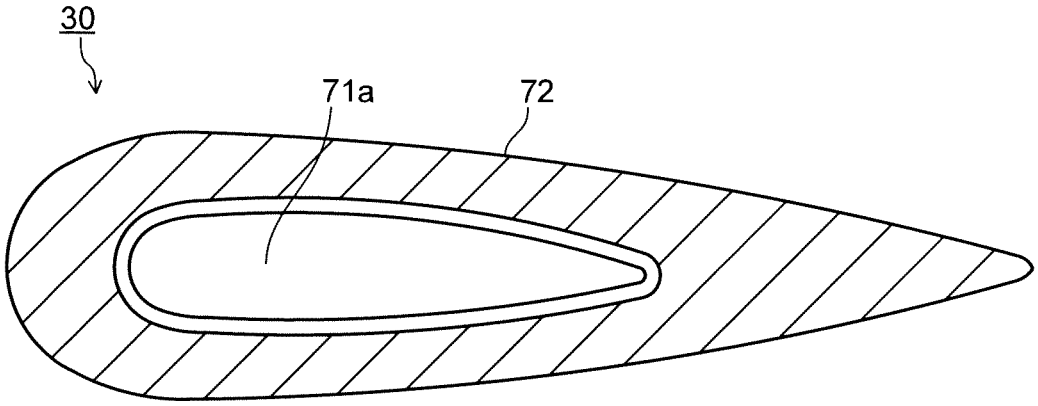
FIG. 20 is a cross sectional view showing a W3-W3 cross section of FIG. 19.
Figure 21A:
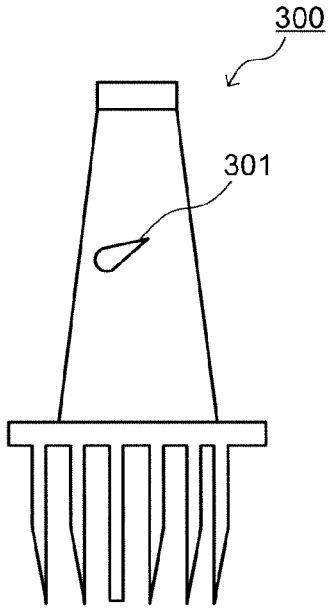
FIG. 21A is a plan view showing a pressure side of the moving blade of a conventional steam turbine.
Figure 21B:
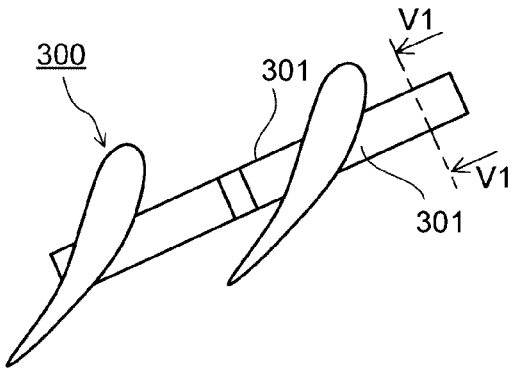
FIG. 21B is a plan view of a turbine moving blade cascade configured of the moving blades of the conventional steam turbine shown in FIG. 21A and seen from a radial outside.
Figure 21C:
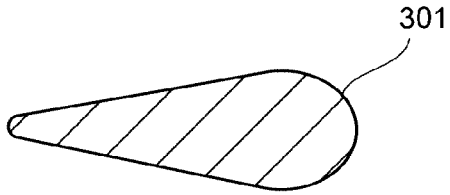
FIG. 21C is a cross-sectional view showing the V1-V1 cross section of FIG. 21B.
Figure 22A:
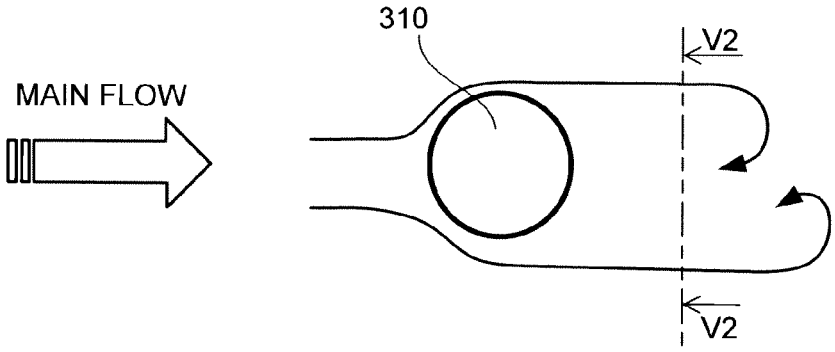
FIG. 22A is a view illustrating a flow around a cylindrical intermediate connecting member provided to a conventional turbine moving blade cascade.
Figure 22B:
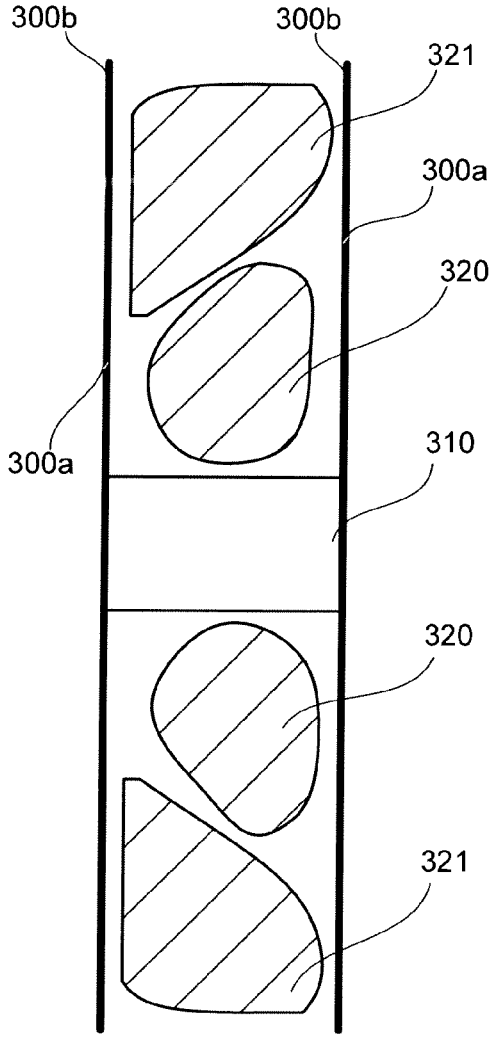
FIG. 22B is a view illustrating a loss region on the V2-V2 cross section of FIG. 22A.
Figure 23A:
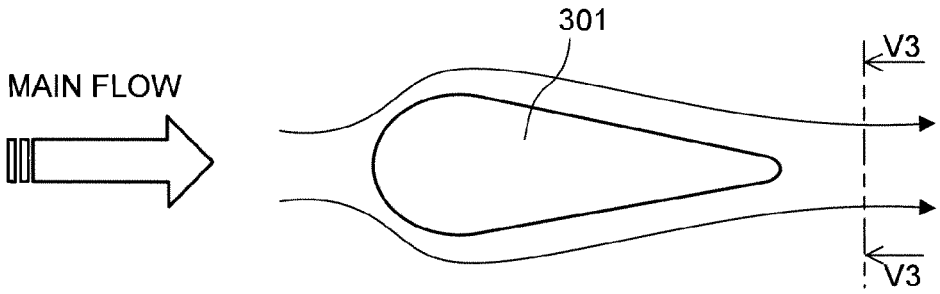
FIG. 23A is a view illustrating a flow around a streamline-shaped intermediate connecting member provided to a conventional turbine moving blade cascade.
Figure 23B:
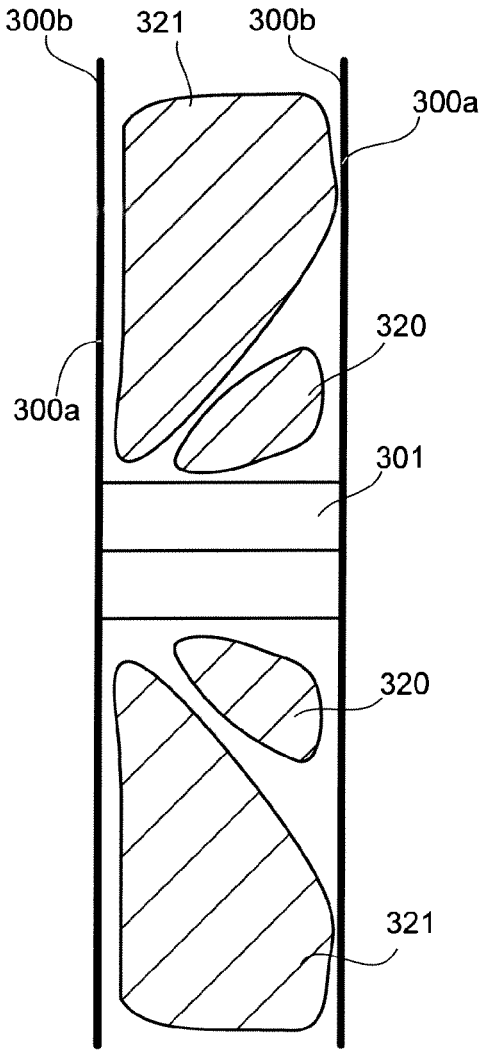
FIG. 23B is a cross sectional view illustrating a loss region on the V3-V3 cross section of FIG. 23A.

FIG. 19 is a plan view of a turbine rotor assembly 10 provided with an intermediate connecting member 30 having another structure seen from a radial outside. FIG. 20 is a view showing the W3-W3 cross section of FIG. 19. In FIG. 19, the tip structure of the moving blade 20 is partly omitted.

As shown in FIG. 19 and FIG. 20, the intermediate connecting member 30 may be configured to have a connection structure comprising seat portions 70 and 71 and a sleeve 72.

As shown in FIG. 19 and FIG. 20, the suction side connecting member 22 and the pressure side connecting member 24 are configured of the pair of seat portions 70 and 71. The seat portions 70 and 71 are formed to have protruded portions 70*a* and 71*a*. In addition, the protruded portions 70*a* and 71*a* of the mutually adjacent pair of seat portions 70 and 71 are connected by a cylindrical sleeve 72.

The construction excepting the above-described connection structure is same as that of the above-described intermediate connecting member 30.

When the moving blades 20 rotate and a centrifugal force is generated, the turbine rotor assembly 10 provided with the above connection structure can suppress or attenuate the vibration of the moving blades 20 by a frictional force based on a surface contact between the protruded portions 70*a* and 71*a* of the seat portions 70 and 71 and the sleeve 72. The construction excepting the above-described connection structure is same as that of the above-described intermediate connecting member 30, so that the same action and effect as those of the above-described intermediate connecting member 30 can also be obtained.

According to the above-described embodiments, an aerodynamic loss between the moving blades can be reduced by optimizing the arrangement position of the intermediate connecting member between the moving blades and the cross-sectional shape of the intermediate connecting member.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A turbine rotor assembly comprising:

a turbine rotor; and a plurality of moving blades implanted in a circumferential direction of the turbine rotor, each of the moving blades forming a flow passage with a circumferentially adjacent moving blade, each of the moving blades having a leading edge on an upstream side of the flow passage and a trailing edge on a downstream side of the flow passage, each of the moving blades comprising:

a suction side connecting member protruded on a blade suction surface of the moving blade, the suction side connecting member being formed along the blade suction surface from the leading edge toward the trailing edge, the suction side connecting member having an upstream edge positioned on a tip of the leading edge and a downstream edge positioned on the blade suction surface between the leading edge and the trailing edge; and a pressure side connecting member protruded on a blade pressure surface, the suction side connecting member of each of the moving blades and the pressure side connecting member of the circumferentially adjacent moving blade being configured to form an intermediate connecting member between the moving blade and the circumferentially adjacent moving blade during a rotation of the turbine rotor, wherein a downstream side end edge of the intermediate connecting member is positioned at an upstream side of a throat portion of the flow passage.

2. The turbine rotor assembly according to claim 1, wherein a distance along the blade suction surface of the moving blade between an upstream side end portion and a downstream side end portion of the suction side connecting member is shorter than a distance along the blade pressure surface of the moving blade between an upstream side end portion and a downstream side end portion of the pressure side connecting member.

3. The turbine rotor assembly according to claim 1, wherein a cross-sectional area of the suction side connecting member along a boundary surface between the blade suction surface of the moving blade and the suction side connecting member is smaller than that of the pressure side connecting member along a boundary surface between the blade pressure surface of the moving blade and the pressure side connecting member.

4. The turbine rotor assembly according to claim 1, wherein the downstream side end edge of the intermediate connecting member is protruded at a downstream side of a line segment which connects a downstream side end portion of the suction side connecting member on the blade suction surface of the moving blade and a downstream side end portion of the pressure side connecting member on the blade pressure surface of the moving blade.

5. The turbine rotor assembly according to claim 1, wherein an upstream side end edge of the intermediate connecting member is protruded at an upstream side of a line segment which connects an upstream side end portion of the suction side connecting member on the blade suction surface of the moving blade and an upstream side end portion of the pressure side connecting member on the blade pressure surface of the moving blade.

6. The turbine rotor assembly according to claim 1, wherein a radial distance from a central axis of the turbine rotor to the blade suction surface of the moving blade where the suction side connecting member is formed is shorter than that from the central axis of the turbine rotor to the blade pressure surface of the moving blade where the pressure side connecting member is formed.

7. The turbine rotor assembly according to claim 1, wherein the intermediate connecting member has a streamline-shape.

8. The turbine rotor assembly according to claim 7, wherein a ratio of a distance between a leading edge of the intermediate connecting member and a maximum position in thickness of the intermediate connecting member to a distance between the leading edge and a trailing edge of the intermediate connecting member is 0.4 or less.

9. The turbine rotor assembly according to claim 7, wherein it is determined on a meridian plane as a cross section taken along a central axis of the turbine rotor that:

an angle formed between a tangent line of a camber line at a leading edge of the intermediate connecting member and a straight line parallel to a central axial direction of the turbine rotor is $\delta$ (degree), an angle formed between a straight line running through a crossing point of a leading edge of a stator blade configuring a same turbine stage as that of the moving blade and a diaphragm inner ring for fixing the stator blade and a crossing point of the leading edge of the moving blade and a rotor disc where the moving blade is implanted and a straight line parallel to the central axial direction of the turbine rotor is $\theta 1$ (degree); and an angle formed between a straight line running through a crossing point of the leading edge of the stator blade and a diaphragm outer ring for fixing the stator blade and a leading edge at a tip of the moving blade and the straight line parallel to the central axial direction of the turbine rotor is $\theta 2$ (degree), and the following relationship is satisfied:

$$(\theta 1+\theta 2)/2-30 \leq \delta \leq (\theta 1+\theta 2)/2+30.$$

10. The turbine rotor assembly according to claim 1, wherein the suction side connecting member of the moving blade and the pressure side connecting member of the moving blade adjacent to the suction side of the moving blade are mutually contacted by rotations of the moving blades.

11. The turbine rotor assembly according to claim 7, wherein the suction side connecting member and the pressure side connecting member are configured as a pair of mutually adjacent seat portions, and the pair of mutually adjacent seat portions is coupled by a sleeve.

12. A steam turbine, comprising:

a turbine casing; and the turbine rotor assembly according to claim 1 provided with the turbine casing.

13. The turbine rotor assembly according to claim 1, wherein the downstream side end edge of the intermediate connecting member is laid in an acceleration area on the blade suction surface of the moving blade such that development of a vortex downstream of the intermediate connecting member is suppressed.

* * * * *

UNITED STATES PATENT AND TRADEMARK OFFICE

CERTIFICATE OF CORRECTION

PATENT NO. : 8,753,087 B2
APPLICATION NO. : 12/979004
DATED : June 17, 2014
INVENTOR(S) : Shibukawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 613 days.

Signed and Sealed this
Twenty-fourth Day of November, 2015

Michelle K. Lee

Michelle K. Lee
*Director of the United States Patent and Trademark Office*